US008286272B2

(12) United States Patent
Lüdi

(10) Patent No.: US 8,286,272 B2
(45) Date of Patent: Oct. 16, 2012

(54) TOILET SEAT AND TOILET EQUIPPED THEREWITH

(76) Inventor: Raymond Lüdi, Meilen (CH)

( * ) Notice: Subject to any disclaimer, the term of this patent is extended or adjusted under 35 U.S.C. 154(b) by 255 days.

(21) Appl. No.: 12/516,681

(22) PCT Filed: Dec. 1, 2006

(86) PCT No.: PCT/CH2006/000680

§ 371 (c)(1),
(2), (4) Date: May 28, 2009

(87) PCT Pub. No.: WO2008/064498

PCT Pub. Date: Jun. 5, 2008

(65) Prior Publication Data

US 2010/0064423 A1 Mar. 18, 2010

(51) Int. Cl.
*E03D 9/052* (2006.01)
*A47K 13/00* (2006.01)
*E03D 9/00* (2006.01)

(52) U.S. Cl. ..... 4/217; 4/209 R; 4/347

(58) Field of Classification Search ..... 4/209 R, 4/211, 213, 214, 216, 217, 218, 219, 347, 4/348, 662; *E03D 9/04, 9/05, 9/052; A47K 13/30*
See application file for complete search history.

(56) References Cited

U.S. PATENT DOCUMENTS

| | | | | |
|---|---|---|---|---|
| 3,386,109 | A * | 6/1968 | Christian et al. | 4/213 |
| 4,984,310 | A * | 1/1991 | Casale | 4/347 |
| 5,991,934 | A * | 11/1999 | Hsu | 4/217 |
| 6,052,837 | A * | 4/2000 | Norton et al. | 4/217 |
| 6,055,677 | A | 5/2000 | McKinley | |
| 6,294,758 | B1 * | 9/2001 | Masao et al. | 219/217 |
| 6,463,595 | B2 * | 10/2002 | Prisco et al. | 4/213 |
| 6,523,184 | B2 * | 2/2003 | Prisco | 4/213 |
| 6,546,567 | B2 * | 4/2003 | Kuzniar | 4/217 |
| 6,553,581 | B1 * | 4/2003 | Lee | 4/217 |
| 6,567,994 | B1 * | 5/2003 | Spurr et al. | 4/217 |
| 6,760,928 | B1 * | 7/2004 | Rodriguez | 4/217 |
| 7,921,477 | B2 * | 4/2011 | Casale | 4/213 |
| 8,069,501 | B2 * | 12/2011 | Casson et al. | 4/217 |
| 2002/0148035 | A1 * | 10/2002 | Kang | 4/213 |
| 2006/0260028 | A1 * | 11/2006 | Casale | 4/240 |
| 2007/0294814 | A1 * | 12/2007 | Lee | 4/348 |

FOREIGN PATENT DOCUMENTS

| | | | |
|---|---|---|---|
| CH | 469 869 | A | 3/1969 |
| FR | 2 512 663 | A1 | 3/1983 |
| FR | 2512663 | A * | 3/1983 |
| GB | 2 178 456 | A | 2/1987 |
| GB | 2 266 901 | A | 11/1993 |

(Continued)

OTHER PUBLICATIONS

International Search Report dated Jul. 20, 2007, issued in corresponding international application No. PCT/CH2006/000680.

(Continued)

*Primary Examiner* — Brian Glessner
*Assistant Examiner* — Joseph J Sadlon
(74) *Attorney, Agent, or Firm* — Ostrolenk Faber LLP

(57) ABSTRACT

In a toilet seat having suctioning of air from the toilet bowl, an advantageous air flow is achieved in the toilet seat by means of the arrangement of elongated suction ports on both sides of the longitudinal center line of the seat.

20 Claims, 3 Drawing Sheets

FOREIGN PATENT DOCUMENTS

| | | | |
|---|---|---|---|
| GB | 2 330 152 | A | 4/1999 |
| JP | 49-130042 | | 12/1974 |
| JP | 2-22200 | | 2/1990 |
| JP | 4-51299 | | 4/1992 |
| JP | 6-84999 | | 12/1994 |
| NL | 1007447 | | 5/1999 |
| WO | WO 2004/070126 | A | 8/2004 |

OTHER PUBLICATIONS

International Search Report dated Jul. 20, 2007 in corresponding International Application No. PCT/CH2006/000680.

English translation of a Japanese Office Action dated May 17, 2011.

* cited by examiner

TOILET SEAT AND TOILET EQUIPPED THEREWITH

BACKGROUND OF THE INVENTION

The invention relates to a toilet seat with intake openings for the suction extraction of air from a toilet bowl, comprising a cavity in the seat, the cavity being connected to the intake openings, and also comprising a suction device and filter means, the seat having a fastening region and a front region. The invention also relates to a toilet equipped with such a seat.

PRIOR ART

GB-A 2 178 456 discloses a toilet seat and a toilet of the type mentioned in the introduction. This toilet seat has an all-round cavity, and air from the toilet bowl can be taken into this cavity via a plurality of round intake openings on the underside of the seat. This takes place via a fan which is arranged outside the toilet seat and by way of which the air which is taken in by it is fed through an activated carbon filter. U.S. Pat. No. 6,055,677 also discloses a toilet seat and a toilet with the intake of air from the toilet bowl. CH-A-469 869 discloses an intermediate ring which is located beneath a toilet seat and has a channel with an individual slot-like opening on one side of the toilet bowl. A second opening on the other side of the toilet bowl is provided as an air outlet in order for an air curtain to be created above the toilet bowl. The extracted air is not guided into a filter.

These arrangements are intended to avoid unpleasant odors by the odor-laden air being extracted by suction from the toilet bowl and the odors being neutralized or the air being channeled away.

SUMMARY OF THE INVENTION

It is the object of the invention to improve the suction extraction of the air and thus the neutralization of the odors.

This is achieved in the case of a toilet seat of the type mentioned in the introduction in that, on either side of the longitudinal center line of the toilet seat, in each case at least one of the intake openings is configured as a slot and in particular the slot or the slots extends or extend essentially from the fastening region to the front region.

It has been found that a small number of elongate slot-like intake openings extending on either side, in particular essentially along the two sides of the seat opening provide for better suction extraction of air from the toilet bowl than is possible using the multiplicity of round openings according to the prior art or using just one slot-like opening on one side of a ring beneath the toilet seat according to the prior art.

Intake openings are preferably provided just to the sides of the longitudinal center line of the toilet seat, and not in the front region of the same; if intake openings are likewise provided there, they are not configured as slot-like openings there. It has been found that the seat-opening region adjacent to the front region should be used particularly for the inflow of fresh air into the bowl, which is adversely affected by slot-like intake openings in the front region. In the case of one embodiment, the slot-like intake openings are provided in the bowl-side side wall of the seat. In the case of another embodiment, the slots are arranged on the underside of the seat. A combination of slots arranged in the side wall and on the underside is also preferred. The intake slots on the underside are preferably configured with a changing opening width, in particular with a width which increases in the direction of the fastening region of the seat. This may also be the case for slots in the side wall.

It has proven to be advantageous if the cavity into which the air enters from the toilet bowl via the intake openings does not extend as a cavity all the way round the entire seat. It is preferable for two cavity parts to be formed, in which case the front of the seat does not contain any cavity into which air is taken.

Preferably at least one of the cavity parts has a changing cross-sectional surface area in the region at least following the intake opening. In combination with the configuration of the intake openings, this makes it possible to achieve a uniform, in particular largely laminar air flow in the seat. In particular the cross-sectional surface area increases from the respectively closed end of the cavity part to the open end or to the end connecting the two cavities. This allows good flow against a filter means arranged in the seat.

It is further preferred if the seat contains a suction device for each cavity part. This arrangement makes it possible to feed a quantity of air which largely avoids the escape of odors from the toilet bowl, and it is possible to dispense with a disruptive fan outside the seat. It is also preferred if the filter means are likewise accommodated in the seat. It is also the case for this arrangement that the configuration with two suction means or fans is particularly advantageous.

BRIEF DESCRIPTION OF THE DRAWINGS

For the purposes of giving a better understanding of the invention and of explaining further advantages, exemplary embodiments will be described in more detail hereinbelow with reference to the drawings, in which.

METHOD(S) OF IMPLEMENTING THE INVENTION

Figure 1:
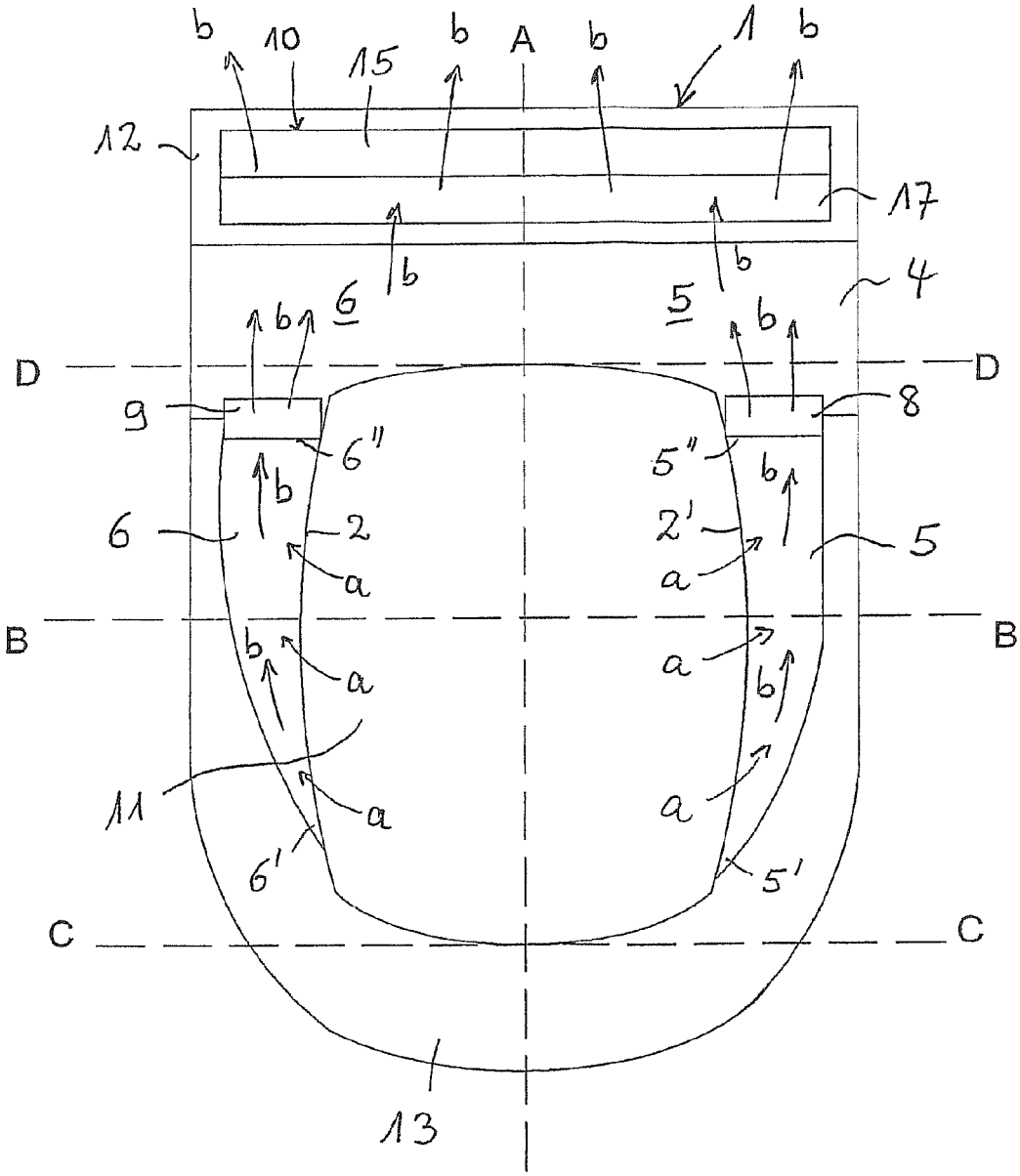
FIG. 1 shows a plan view of a toilet seat according to the invention, the top side of the seat being illustrated in a partially transparent state.

FIG. 1 shows a toilet seat in plan view, that is to say as seen in the direction of the seat surface. The latter is taken to be transparent in FIG. 1, in order to show the cavity and the rest of the elements in the seat. The toilet seat 1 is of conventional form having an annular seat surface with a seat opening 11. The seat is configured symmetrically in relation to its longitudinal center line A and, in the rear part, has a fastening region 12 which has fastening means (not illustrated) in order for the seat to be arranged on a toilet. The fastening region here is essentially the region behind the imaginary line D, which forms a tangent to the seat opening. The seat is arranged in a known manner such that it can be fastened for pivoting action on the toilet. A front region 13 of the seat may be defined such that it is located in front of the imaginary line C, which forms a tangent to the seat opening 11. The configuration of such a seat from plastic, wood or other materials is known to a person skilled in the art and need not be explained any more fundamentally here.

The seat according to the invention has an interior cavity 4. In the preferred embodiment shown, the cavity 4 is subdivided into two cavity parts 5 and 6 located on either side of the longitudinal center line A. These cavity parts 5 and 6 are connected to one another in the fastening region 12. In contrast, they are closed, or are not connected to one another, in the front region 13 of the seat 1. According to the invention, then, the seat has, on either side of the line A, slot-like intake openings 2, 2' through which air can be taken into the cavity from the toilet bowl. These elongate slots extend essentially between the front region 13 and fastening region 12, but preferably not into the same. In FIG. 1, the arrows a indicate how air enters from the seat opening 11 or from the toilet bowl, through the slot-like openings 2, 2', into the cavity 4 or the lateral cavity parts 5, 6.

In the case of the preferred embodiment of FIG. 1, the cavity parts 5 and 6 are configured such that their cross-sectional surface area changes over part of the cavity. It can be seen that at its front end region 5', at which, with the exception of the slot opening 2', it is closed, the cavity part 5 in the first instance has a small cross-sectional surface area and widens in the direction of the fastening region 12. A similar profile with a somewhat different shape is illustrated for the cavity part 6. The change in the cross-sectional surface area is selected, in conjunction with the shape of the slot-like intake openings 2 and 2', such that as uniform as possible a flow, in particular laminar flow, is established in the respective cavity part at least in the region of the intake slots. The air flow in the cavity is indicated by the arrows b. In the preferred exemplary embodiment shown, the suction means, which takes in the air from the toilet bowl via the intake slots, has two fans 8 and 9, which are each assigned to a cavity part 5 and 6, respectively. The suction means may be constituted, for example, by known axial fans or radial fans which are driven in particular by a low-voltage electric motor, of, for example, 12 volts. The fans 8 and 9, then, are operated via a transformer which transforms the voltage of the power supply system for the fan motors. It is possible to provide the seat 1 with a manually actuable switch for operating the suction means. It is also possible to provide a switch which operates the suction device when the toilet seat is subjected to loading by an individual. It is additionally possible to provide a circuit which provides for continued operation of the suction device for a certain period of time after the switch has been switched off, or relieved of loading, in order to provide for continued odor extraction for some time following use of the toilet. The configuration of such switching-on means and timers are known to a person skilled in the art and need not be explained in any more detail here. Instead of the preferred two suction-device fans, it is also possible to provide just a single fan, which is arranged such that it can take in air via the two intake openings 2, 2'. In the case of the preferred embodiment illustrated in FIG. 1, furthermore, the filter means 10 is arranged in the seat itself as a filter block including an activated carbon filter 15 and a prefilter 17, the prefilter 17 being arranged upstream of the carbon filter 15 as seen in the flow direction. The air flowing out of the fans 8 and 9 passes, in the first instance, through the prefilter 17 and then through the activated carbon filter 15 and can then flow outward, in a cleaned state, out of the seat 1. Corresponding air-outlet openings are provided in the rear part of the fastening region 12, but are not illustrated. The arrows b indicate how the air in the cavity parts 5, 6 on either side passes to the fans 8, 9 and flows through the latter and passes into the interconnected cavity parts 5, 6 and flows outward via the filter means 10. That part of the seat which accommodates the filter means, for this purpose, is provided with air-outlet openings downstream of the filter, as seen in the flow direction. This part of the seat also has a cover, in order that the filter means can be easily exchanged.

Figure 2:
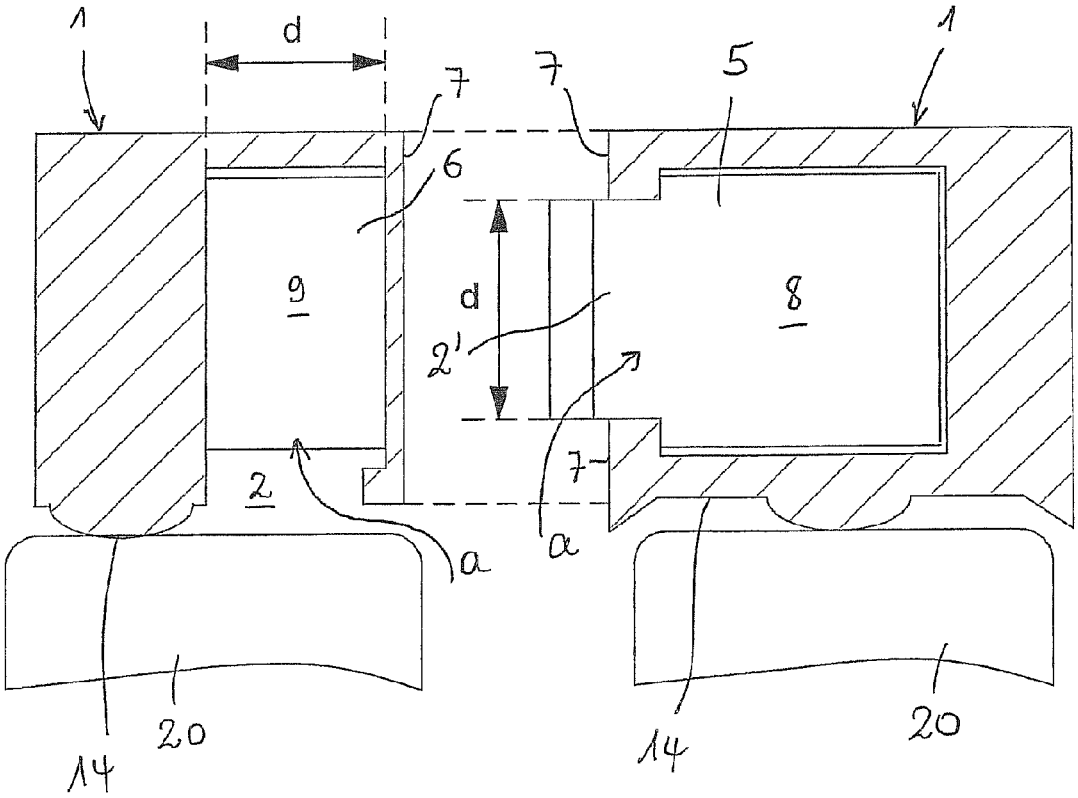
FIG. 2 shows a sectional illustration along line B-B from FIG. 1 with two different configurations of the intake openings in the left-hand half and the right-hand half of the figure.

FIG. 2 shows a sectional illustration along line B-B from FIG. 1, different embodiments being illustrated in the left-hand half and the right-hand half of FIG. 2. Usually just one configuration or the other is selected for a toilet seat 1, in which case the same configuration is selected on both sides of the longitudinal center line A. For the purpose of explaining different embodiments, however, FIG. 2 has been divided up accordingly. The right-hand half of FIG. 2 illustrates a configuration of the toilet seat 1 in which the slot-like intake opening 2' is arranged in the bowl-side side wall 7 of the seat. The air thus enters laterally into the cavity 5 of the seat 1. It is illustrated how the seat 1 rests on an edge 20 (merely indicated) of a toilet bowl. It is possible for the slot-like opening 2' to be a single elongate opening or to be subdivided into a plurality of elongate openings. The opening width d of the intake slot may be the same over the entire length of the slot or may change along this length. For example, it is possible for the opening width of the slot to be smaller in the front region 5' of the cavity than in the rear, fastening region 5". The left-hand half of FIG. 2 illustrates another embodiment, in which the one elongate intake opening, or if need be a plurality of elongate intake openings, is or are arranged on the underside of the seat. In the case of the intake opening 2 being arranged on the underside, the opening width d thereof preferably differs along the length of the slot. The opening width preferably corresponds with the change in cross section of the cavity 6, so that it is also the case that this embodiment preferably results in a small opening width in the region of the closed end 6' of the cavity and a larger opening width in the rear, fastening region 6" of the cavity 6. It is possible here in particular for the opening width of the slot to increase continuously from a small opening width in the front region to a larger opening width in the fastening region.

Figure 3:
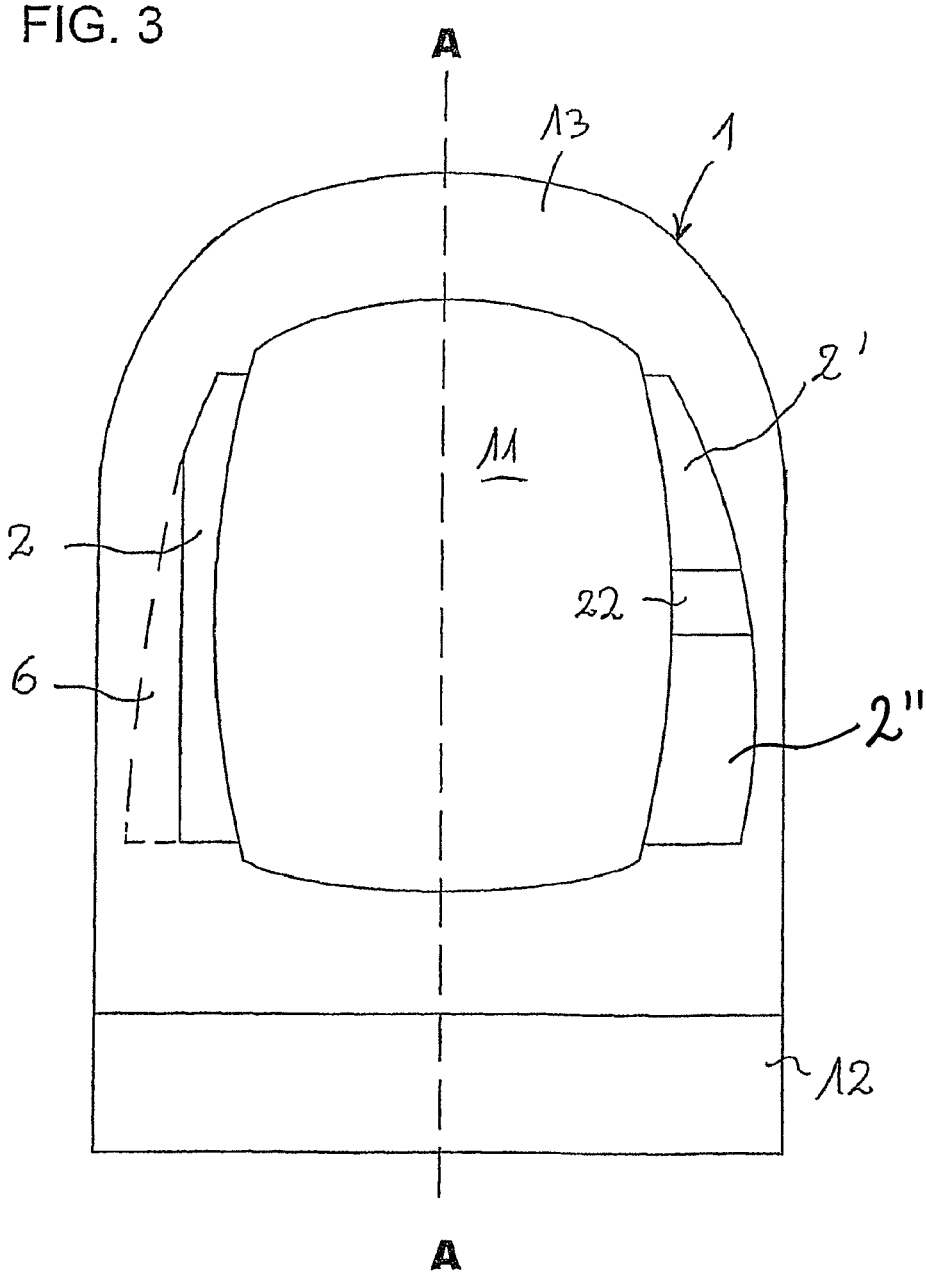
FIG. 3 shows a view of a seat from beneath.

FIG. 3 shows the embodiment with intake openings on the underside of the seat 1 in a view of the seat from beneath. The right-hand half of FIG. 3 illustrates an intake opening 2' as an elongate slot with an increasing opening width. The slot could also be formed by a plurality of elongate slots, in which case a crosspiece 22 would be provided along the slot. In the case of the embodiment which is shown in the right-hand half, the slot opening essentially corresponds with the boundaries of the cavity, and the latter therefore has a cross-sectional surface area which changes in a manner corresponding to the slot width. The left-hand half of the figure illustrates an elongate slot-like intake opening 2 which, with the exception of its front region, has an essentially constant opening width. A dashed line, furthermore, is used to indicate the cavity part 6, which in this case has a cross-sectional surface area which, in the direction of the fastening region, does not correspond with the opening width of the slot 2.

While the present application describes preferred embodiments of the invention, it should be pointed out that the invention is not restricted to these embodiments and may also be configured in other ways which fall within the scope of the following claims.

The invention claimed is:

1. A toilet seat with intake openings for suction extraction of air from a toilet bowl, the toilet seat comprising:

a cavity positioned in the seat, the cavity being connected to the intake openings;

a suction device positioned and configured to suction the air through the intake openings;

a filter configured to filter the air suctioned through the intake openings;

a seat opening comprising an opening in a vertical direction extending through a central portion of an entirety of the toilet seat, the seat opening comprising forward and rearward curved surfaces;

a fastening region extending rearward of the rearward curved surface; and a front region extending forward of the forward curved surface, wherein the intake openings are positioned in the seat, are configured to conduct air from the toilet bowl to the cavity, and comprise a first intake opening positioned on a first side of a longitudinal center line of the seat and at least one intake opening of the intake openings is configured as an elongate slot, wherein the cavity comprises a first cavity part on the first side of the longitudinal center line of the seat and a second cavity part on a second side of the longitudinal center line of the seat, and the first cavity part widens in the direction of the fastening region such that a cross-sectional surface area of the first cavity is proportional to an opening width of the first intake opening, wherein the suction device is positioned upstream from the filter in the direction of the air flow, and comprises at least one device located on the first side of the longitudinal center line of the seat and at least one device located on the second side of the longitudinal center line of the seat, and wherein the filter extends from the first side of the longitudinal center line of the seat to the second side of the longitudinal centerline of the seat.

2. The toilet seat as claimed in claim 1, wherein each intake opening comprises a single elongate slot provided in a seat half, the seat half being defined by the longitudinal center line of the seat and a second intake opening positioned on a second side of the longitudinal center line, each of the single elongated slots extending from the fastening region to the front region.

3. The toilet seat as claimed in claim 1, wherein the front region is free of intake openings.

4. The toilet seat as claimed in claim 1, wherein the toilet seat comprises a side wall facing the seat opening and the intake openings are arranged in the side wall of the toilet seat.

5. The toilet seat as claimed in claim 1, wherein the toilet seat comprises an underside facing the toilet bowl and the intake openings are arranged on the underside of the seat.

6. The toilet seat as claimed in claim 1, wherein each intake opening has a plurality of opening widths such that closer to the fastening region each intake opening has an opening width larger than opening widths farther from the fastening region.

7. The toilet seat as claimed in claim 6, wherein the second cavity part has a changing cross-sectional surface area such that the cross-sectional surface area increases from a front end of the second cavity part to the fastening region of the seat, and wherein the increase in the opening width of each elongate slot is proportional to an increase in the cross-sectional surface area of the second cavity part.

8. The toilet seat as claimed in claim 1, wherein the two cavity parts are connected to one another in the fastening region and comprise front ends that are closed.

9. The toilet seat as claimed in claim 1, wherein the second cavity part has a changing cross-sectional surface area such that the cross section increases from a front end of the second cavity part to the fastening region of the seat.

10. The toilet seat as claimed in claim 1, wherein the suction device comprises at least one fan arranged in the seat.

11. The toilet seat as claimed in claim 10, wherein the suction device comprises a first fan arranged on a first side of the longitudinal center line of the seat and a second fan positioned on a second side of the longitudinal center line of the seat.

12. The toilet seat as claimed in claim 11, wherein the fans are arranged in the cavity.

13. The toilet seat as claimed in claim 1, wherein the suction device comprises a fan arranged in each cavity part.

14. The toilet seat as claimed in claim 1, wherein the filter is arranged in the seat.

15. The toilet seat as claimed in claim 1, wherein the filter comprises an activated carbon filter and a prefilter, and the prefilter is arranged upstream of the activated carbon filter in the direction of the air flow.

16. The toilet seat as claimed in claim 1, wherein the filter is formed by a filter block arranged in the fastening region transversely to the longitudinal center line.

17. A toilet comprising a toilet seat as claimed in claim 1.

18. The toilet seat as claimed in claim 1, wherein the intake openings comprise a plurality of slots separated by one or more crosspieces.

19. A toilet seat with intake openings for suction extraction of air from a toilet bowl, the toilet seat comprising:

a cavity positioned in the seat, the cavity being connected to the intake openings;

a suction device positioned and configured to suction the air through the intake openings;

a filter configured to filter the air suctioned through the intake openings;

a seat opening comprising an opening in a vertical direction extending through a central portion of an entirety of the toilet seat, the seat opening comprising forward and rearward curved surfaces;

a fastening region extending rearward of the rearward curved surface; and a front region extending forward of the forward curved surface, wherein the intake openings are positioned in the seat, are configured to conduct air from the toilet bowl to the cavity, and comprise a first intake opening positioned on a first side of a longitudinal center line of the seat and at least one intake opening of the intake openings is configured as an elongate slot, wherein the front region is free of intake openings, wherein a portion of the cavity, positioned between the fastening region and the front region, is formed by at most two vertically extending walls so that the air flowing through the portion of the cavity flows from the intake openings to the suction device without the path of the air flow reversing direction, and wherein the filter extends from the first side of the longitudinal center line of the seat to a second side of the longitudinal center line of the seat.

20. A toilet seat with intake openings for suction extraction of air from a toilet bowl, the toilet seat comprising:

a cavity positioned in the seat, the cavity being connected to the intake openings;

a suction device positioned and configured to suction the air through the intake openings;

a filter configured to filter the air suctioned through the intake openings;

a seat opening comprising an opening in a vertical direction extending through a central portion of an entirety of the toilet seat, the seat opening comprising forward and rearward curved surfaces;

a fastening region extending rearward of the rearward curved surface; and a front region extending forward of the forward curved surface, wherein the intake openings are positioned in the seat, are configured to conduct air from the toilet bowl to the cavity, and comprise a first intake opening positioned on a first side of a longitudinal center line of the seat and at least one intake opening of the intake openings is configured as an elongate slot, wherein the first intake opening on the first side of the longitudinal center line of the seat extends for at least a majority of the distance between the front region the fastening region, and wherein the suction device is positioned upstream from the filter in the direction of the air flow, and comprises at least one device located on the first side of the longitudinal center line of the seat and at least one device located on a second side of the longitudinal center line of the seat, and wherein the filter extends from the first side of the longitudinal center line of the seat to the second side of the longitudinal centerline of the seat.

* * * * *